US008136281B2

(12) United States Patent
MacDougall

(10) Patent No.: US 8,136,281 B2
(45) Date of Patent: Mar. 20, 2012

(54) HIGHWAY MESSAGE BOARD SIGN TRAILER

(76) Inventor: Kenneth L. MacDougall, Waverley (CA)

( * ) Notice: Subject to any disclaimer, the term of this patent is extended or adjusted under 35 U.S.C. 154(b) by 237 days.

(21) Appl. No.: 12/669,107

(22) PCT Filed: Jul. 18, 2008

(86) PCT No.: PCT/CA2008/001326

§ 371 (c)(1),
(2), (4) Date: Jan. 14, 2010

(87) PCT Pub. No.: WO2009/009904

PCT Pub. Date: Jan. 22, 2009

(65) Prior Publication Data

US 2010/0187794 A1 Jul. 29, 2010

(30) Foreign Application Priority Data

Jul. 18, 2007 (CA) ..... 2592108

(51) Int. Cl.
*G09F 21/04* (2006.01)

(52) U.S. Cl. ..... 40/590; 280/491.1

(58) Field of Classification Search ..... 40/590; 280/491.1–491.5; 296/21
See application file for complete search history.

(56) References Cited

U.S. PATENT DOCUMENTS

| | | | | |
|---|---|---|---|---|
| 2,438,032 | A * | 3/1948 | Bready | 280/416.1 |
| 3,574,388 | A * | 4/1971 | Stone | 296/168 |
| 6,119,384 | A * | 9/2000 | Fischer | 40/606.02 |
| 7,780,185 | B2 * | 8/2010 | McConkey et al. | 280/656 |
| 2009/0322060 | A1 * | 12/2009 | Macdougall | 280/491.3 |

FOREIGN PATENT DOCUMENTS

| | | | |
|---|---|---|---|
| CA | 2460262 | A1 | 5/2005 |
| CA | 2579607 | A1 | 8/2008 |
| CA | 2585677 | A1 | 10/2008 |
| WO | WO 2005085048 | A1 * | 9/2005 |

* cited by examiner

*Primary Examiner* — Casandra Davis
(74) *Attorney, Agent, or Firm* — Brooks Kushman P.C.

(57) ABSTRACT

A low profile highway sign trailer wherein the message board positioned lengthwise resting upon the trailer frame during transport. The rear end of the sign board is fastened to and raised vertically by a rack, utilizing gearing and portable power drill or the like. The trailer tongue pivots on the frame to a vertical position utilizing a curved rack, to add support to the forward end of the sign board and locked in that position. Two handles are provided for manually positioning the trailer at a desired display angle. A rear section may house a generator and/or battery packs and solar panels are located on the roof. The trailer can store equipment accessible from both sides and the rear.

14 Claims, 5 Drawing Sheets

HIGHWAY MESSAGE BOARD SIGN TRAILER

FIELD OF THE INVENTION

The present invention relates to a towable apparatus for transporting and displaying highway message board or other signs, as well as transporting equipment and materials related thereto.

BACKGROUND OF THE INVENTION

Most conventional highway message boards are of significant height, presenting problems during transport, storage and high wind conditions and typically have limited additional utility apart from carrying and presenting a sign or message board. The protruding tongue can be a safety hazard and provides a means of unauthorized removal of the trailer; therefore some find it necessary to remove the tongue and store it in another vehicle. Others remove the wheels for security purposes or chain the trailer to another vehicle or other device.

The present invention evolved from Canadian patent; No. 2,460,262 MULTIPLE USE ADJUSTABLE SECURITY TRAILER FOR TRANSPORTATION, STORAGE AND HOUSING; and Canadian Application No. 2,579,607 SECURITY TRAILER AND SECURITY TRAILER TONGUE SUPPORTS; by the same inventor. Features from these application are incorporated but not included in the claims. The present invention introduces a new design for highway message board and sign trailers not found in any prior art teachings.

SUMMARY OF THE INVENTION

The present invention overcomes the problems of most prior art designs by providing a vertical fore- and aft oriented highway message board which rests on the trailer frame in a "down" position, providing a lower profile during transport, and which may be easily raised or lowered at the display site.

It is an object of the present invention to provide a highway message board whose trailer frame may be supported, in the display mode by flip-down legs provided, however, conventional leveling jacks may be employed if necessary.

Another object of the present invention is to provide a sign trailer that has no protruding tongue in the display mode.

A further object of the present invention is to reduce the number of vehicles required at a work site by providing a message board sign trailer which, having a box provided, also serves as an equipment and supplies carrier, accessible from both sides and the rear, and includes solar panels on the roof.

Another object of the present invention is to provide a towable trailer for displaying message board or other signs, comprising a wheel mounted trailer frame with a front vertical support means with open center strip, mounted on the trailer frame, which aligns with and overlaps the front upper guide channel mounted on the "Y" shaped tongue when in the second/vertical position; the front end of the message board has two aligned threaded guide rods fixed near its lower end, which are positioned within said vertical support means and which may be secured in the lowered position utilizing threaded fasteners with washers in the transport mode, and which may be loosened to permit the sign to be raised then retightened when at the fully upward display position, conjoining said front vertical support means and the upper locating means fixed on the tongue. In this position, the rear vertical support track is of lower height than the front end portion of the message board.

Accordingly, the "Y" shaped tongue has two side arms which, at the rear, insert into and pivot on the trailer frame, where they are secured in this first position by a hitch means while the trailer is in the transportation mode; a pair of laterally extended flip-down legs affixed one each side of the frame are proportioned to contact a ground surface when in the down position; said tongue being pivotable by means of a curved rack and pinion, utilizing a power drill and suitable gear box, between a lowered first position for transport and a vertical second position, for sign display; whereby, in the horizontal position, said forward hitch means is connectable to a towing vehicle, and while in the vertical position, lower portions of the side arms are capable of contacting a ground surface to support the trailer and the message board, and where it may be secured with a locking device utilizing aligned brackets on the tongue and the frame.

Another aspect of the present invention provides a method of converting the trailer from a transportation mode into a display/security mode, wherein the hitch pin inserted in the left flip-down leg, is removed, enabling it to pivot downward into a vertical position, about the pivot means, thereby contacting the ground and vertically supporting the trailer frame; the front tow-bar with forward hitch means is disconnected from the tow vehicle; the hitch pin inserted in the right flip-down leg hitch means, is removed, enabling it also to pivot downward into a vertical position about the pivot means thereby contacting the ground, also giving support to the frame.

Another aspect of the present invention provides a means of raising and lowering the message board, the rear end of which is fixed on a straight lubricated rack positioned and secured within a rear vertical support track where it may be moved vertically by a drive pinion utilizing a power drill and suitable gear box mounted on the interior front wall of the trailer box; or another suitable method, such as a hydraulic cylinder may be employed.

Another aspect of the present invention provides a reinforcing angle bar with handle attached, which is positioned on the lower front corner of each side of the trailer frame member, forward of the pivot means, to strengthen the frame and make provision for manual maneuvering of the trailer.

It is also an object of the present invention to provide adaptations for:

(a) a sign trailer configuration in which the sign board is fixed securely on the frame and does not raise for display;

(b) a sign trailer configuration which is an "off-road" portable roadside sign, fixed securely on the frame, wherein the wheels cannot be removed; sections of the frame or supports may be filled with concrete to provide added weight, and leveling jacks or side braces are provided as necessary for stability; the axle is positioned sufficiently rearward so as to facilitate loading on a truck by utilizing a hydraulic tailgate.

Additional objects and advantages will become apparent from a careful reading of the detailed description provided herein, with appropriate reference to the accompanying drawings.

BRIEF DESCRIPTION OF THE DRAWINGS

Embodiments of the invention will be described below with reference to the accompanying drawings, in which.

DETAILED DESCRIPTION OF THE PREFERRED EMBODIMENTS

Figure 1:
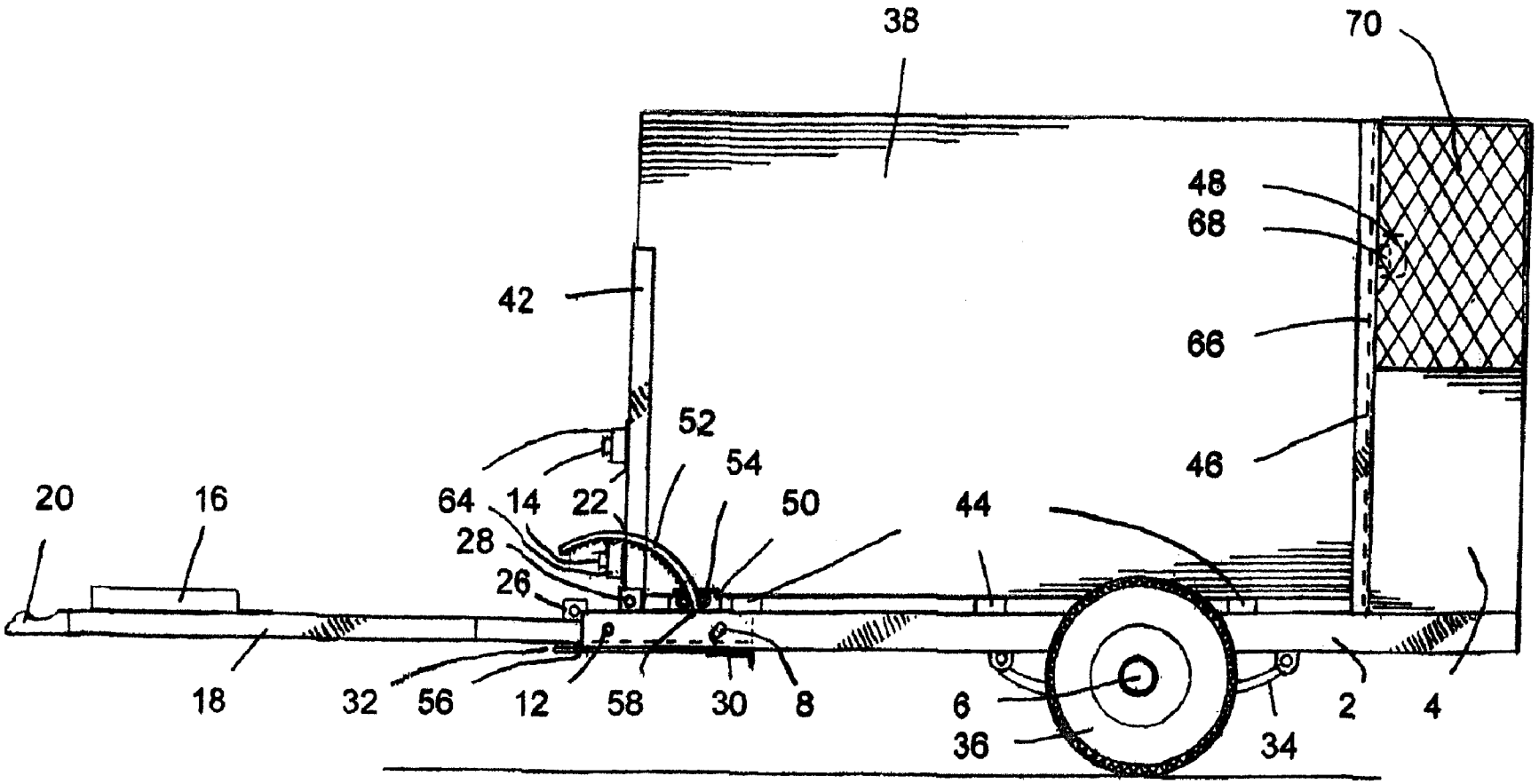
FIG. 1 is a side view of a trailer with highway message display board or other sign according to one embodiment of the present invention in the transportation mode with the tow bar tongue means in the first position.
Figure 2:
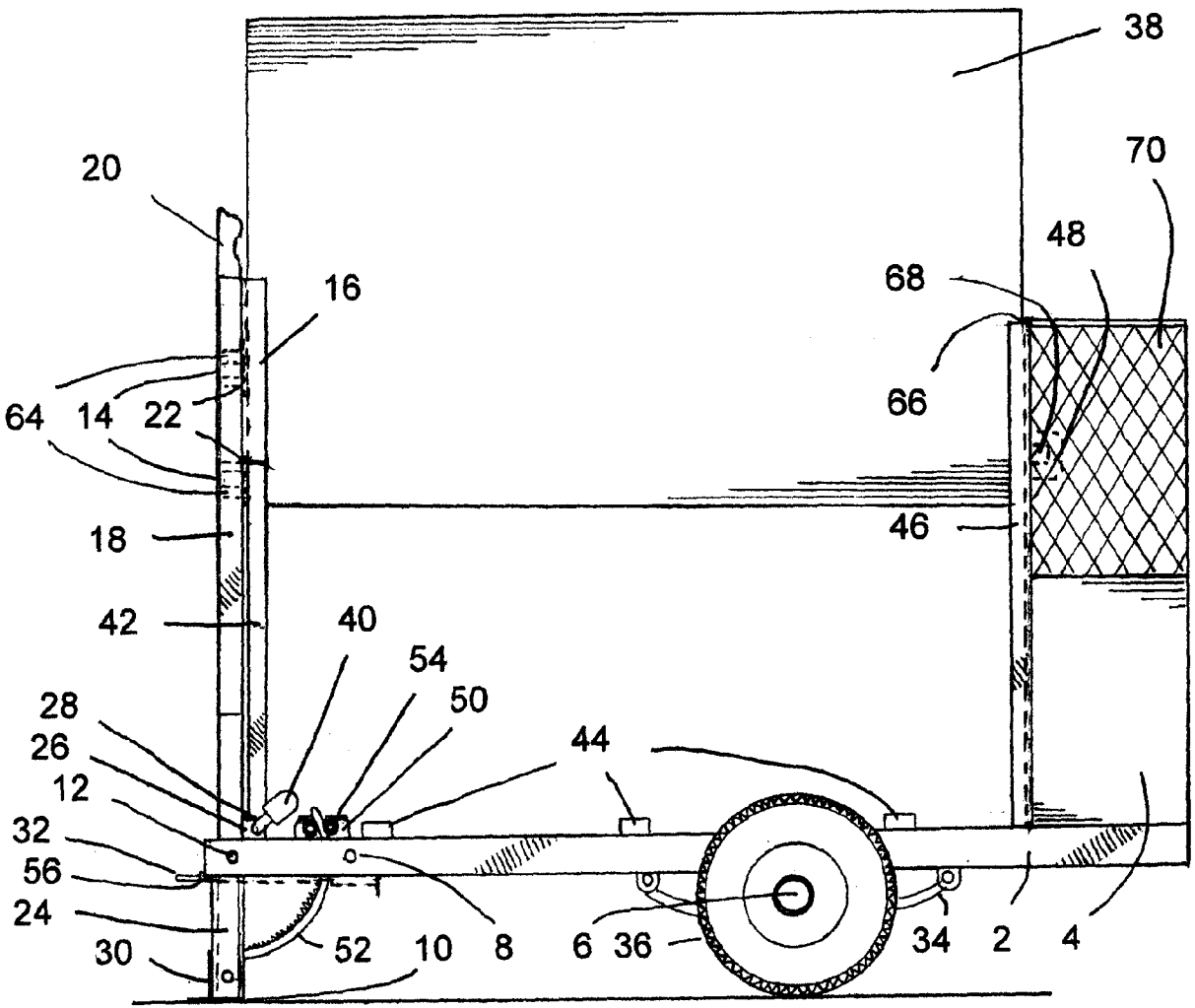
FIG. 2 is a side view of a trailer with the tow bar tongue means in the second secured position with the message board sign in its raised display mode.
Figure 3:
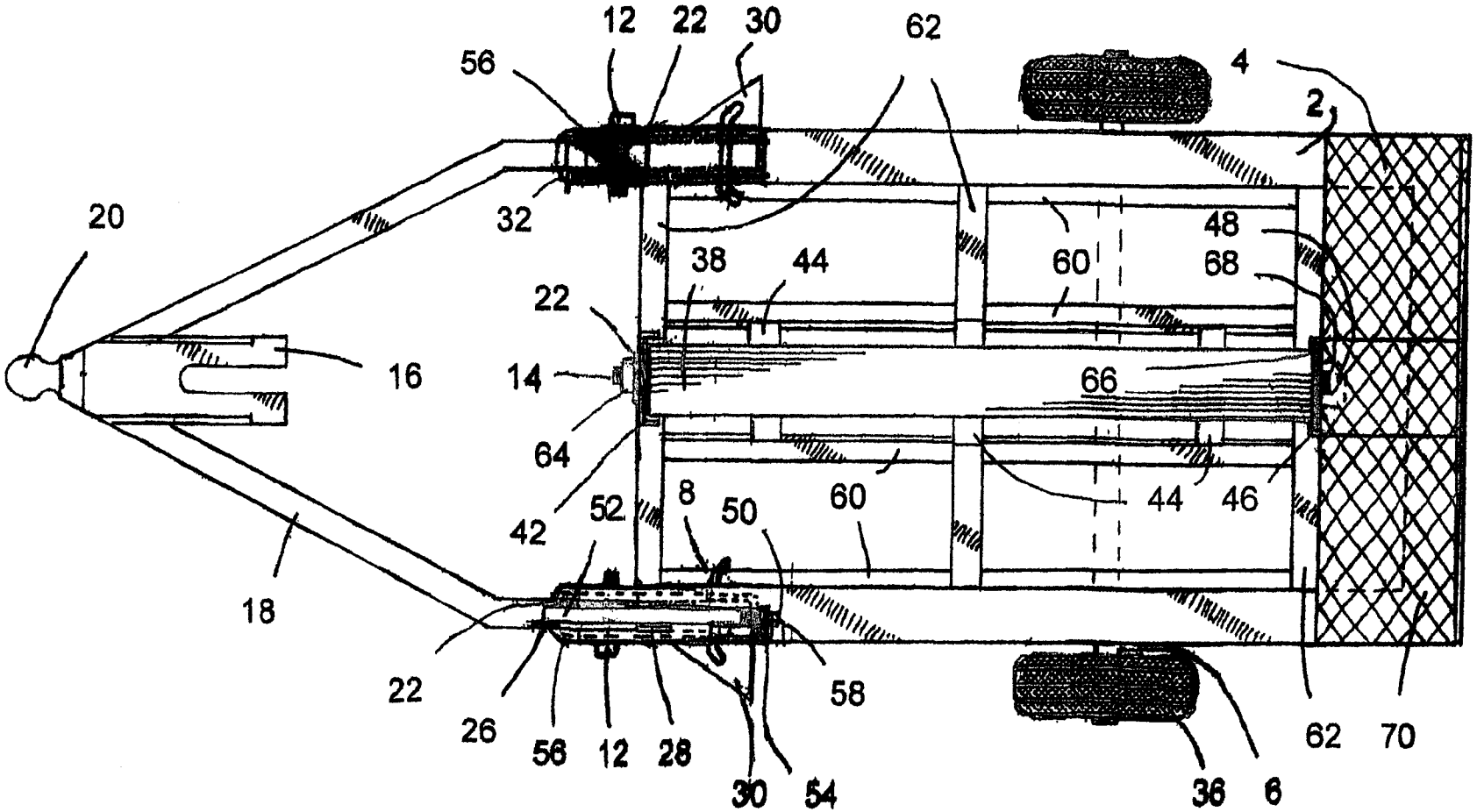
FIG. 3 is a top view of a trailer with a message board sign in its transportation mode, with the tow bar tongue means in the first position.

Referring to FIGS. 1, 2, and 3, a wheel mounted trailer preferably consists of a two piece metal base support, wherein a front piece is a Y shaped tongue (18) with front tow bar tongue means and coupler hitch (20) individual rear side members of which insert into a rectangular frame (2) and having a pivot means (12), utilizing spacing washers (22) allowing the tongue to pivot between a first position in which the tongue means is generally horizontal, when the tongue means is connected to the towing vehicle, and a second, raised position, generally perpendicular to the first position when the trailer vehicle is stationary. Hitch means (8) for temporarily securing the rear/lower portion of the tongue means (24) in the first position are provided, as are frame securing means (26) and tongue securing means (28) for the tongue means in the second position, where a locking device (40) may be employed.

The rectangular trailer frame (2) utilizes cross re-enforcing members (62), side supports (60), springs (34), axle (6) and tires (36) and employs cross base supports (44) on which a vertically positioned message board (38) rests, being secured by a rear vertical support track (46) which provides guided vertical movement of the rear end of the message board to an elevated position, and a fixed lower front vertical support means (42) guiding the front end. A front upper guide channel (16) mounted on the top side of the tow bar tongue means is positioned to engage a front end portion of the message board (38), when the trailer vehicle is stationary and the tongue means is in the second position. In that position, said guide channel (16) forms an overlapping continuation of the front vertical support means (42) wherein threaded rods (14) may move vertically, and where, in the fully raised position, threaded fasteners (64) are tightened to support the front end of the message board, the lower of which also conjoins the overlapping front vertical support means (42) and front upper guide channel (16).

Reinforcing angle bars (56) with attached handle (32) are fixed at each lower front corner of the trailer frame (2). In the trailer's transportation mode, a flip-down leg (30) is affixed each side of the frame at the pivot means (12) being secured for travelling at the flip-down hitch means (8), and which also give ground support to the trailer frame when the tongue means is disconnected from the vehicle.

The pivot means (12) is inserted into a hole aligned in the exterior wall of the trailer frame, through a washer (22) an upper exterior part of the flip-down leg (30), a second washer, the exterior side wall of the tongue means (18), the interior wall of the same tongue, a third washer, the interior wall of the flip-down leg, a fourth washer and an interior wall of the side of the trailer frame and is secured with a fastener, such as a locknut. A hitch pin (8) is inserted through the flip-down leg hitch means, aligned through an exterior rearward wall of the side of the frame (2) an exterior side of the flip-down leg (30), an exterior wall of the tongue means (18), an interior wall of that same tongue, an interior wall of the flip-down leg, and an interior wall of the side of the frame (2) and is secured with a suitable fastening method.

The tongue means (18) is pivoted about the pivot means (12) utilizing a hydraulic cylinder or a curved rack (52) which is fixed to the lower end of the tongue means (24) and passes up through, or alongside an opening, in the trailer frame (58) where it is engaged and driven by a pinion located in a gear assembly (50), guided by a roller bearing (54), and powered by a portable drill, or otherwise. The curved rack (52) pushes the lower end of the tongue (24) to the second position, where its rearward end means (10) contacts the ground to give support, and reversal restores it to the travelling first position, within the trailer frame (2), where it may be secured, along with the extended flip-down leg, by a hitch means (8).

Figure 4:
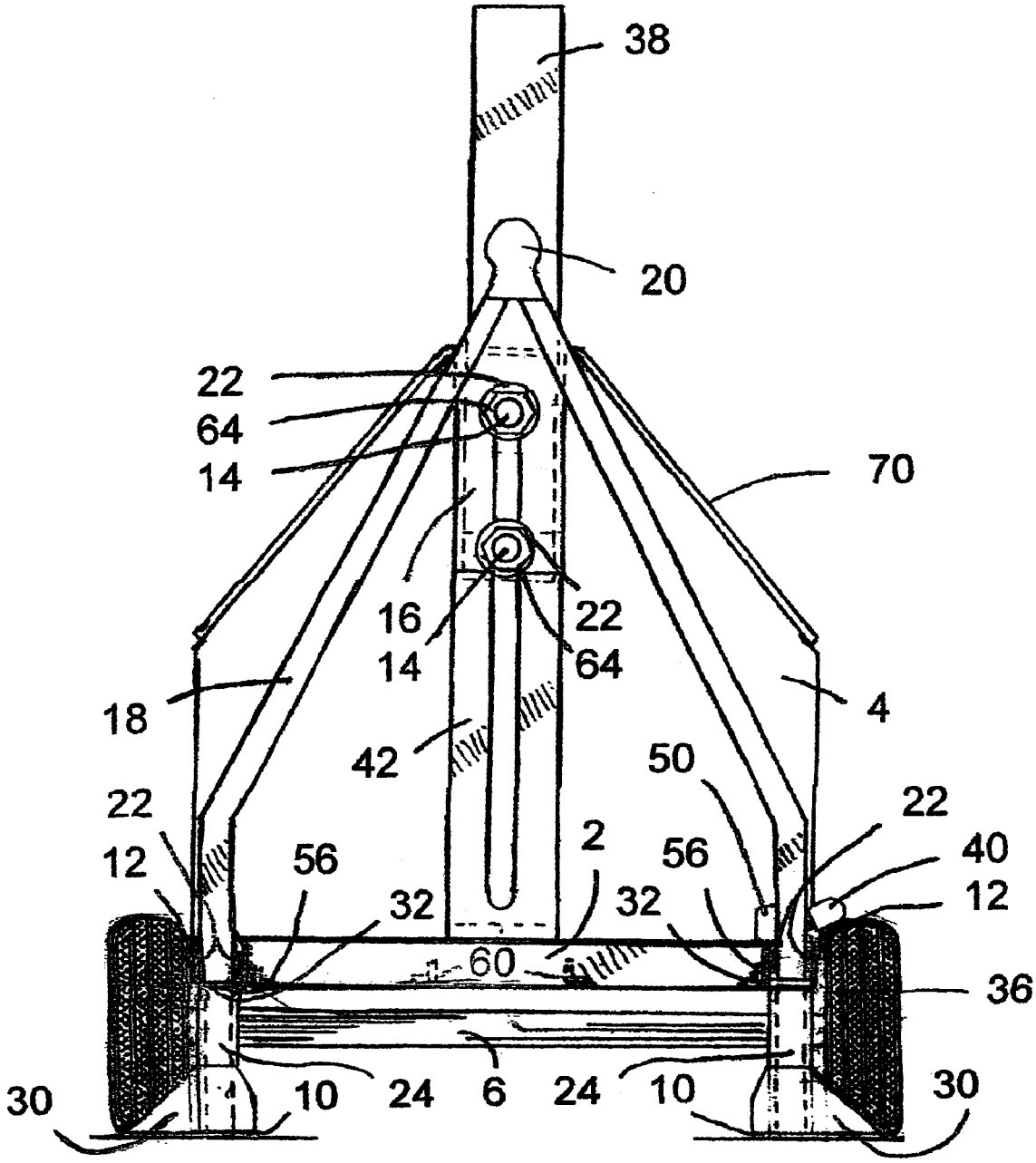
FIG. 4 is a front end view of a trailer with a message board sign in its raised display and secured mode, with tow bar tongue means in the second position.
Figure 5:
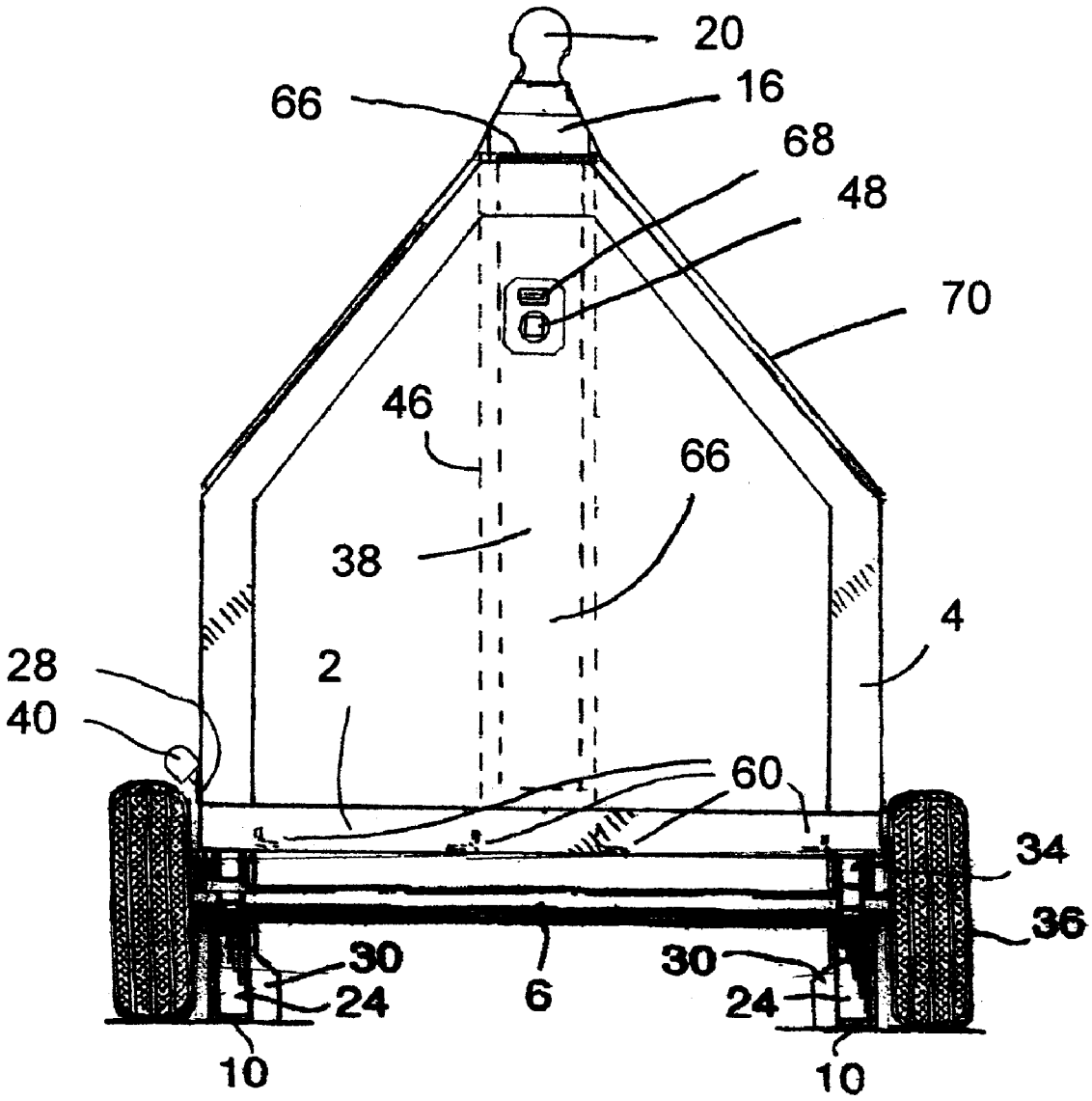
FIG. 5 is a rear end view of a trailer with the message board sign in its lowered setup mode, with tow bar tongue means in the second position.

Referring now to FIGS. 3, 4 and 5, a trailer wherein a message board (38) is mounted at the rear on a lubricated straight rack (66) and is secured by and slides vertically within a rear vertical support track (46) where it is engaged by a drive pinion (68); located in a gear box (48) mounted on an interior front wall of a rear equipment compartment box (4) and which may be powered by a portable drill or other suitable means to raise or lower the message board. The box (4) may house a generator, battery packs, or other desired supplies or equipment and may also have solar panels (70) located on the roof, or attached thereto.

The present invention will be manifest in two additional trailer adaptations wherein both have message boards, or other desired signs, that do not raise; one of which is designed for highway use and the other for "off-road" roadside sign boards. The latter will feature wheels that cannot be removed; concrete weighting in the trailer frame and axle positioned rearward to facilitate transport by utilizing a hydraulic truck tailgate.

A method for converting a trailer vehicle from a transportation mode to a message board display mode, wherein the vehicle has a wheel-mounted trailer frame (2) with tow bar tongue means, having a front end with a coupler hitch (20) for connecting to a towing vehicle, and pivot means (12) connecting the tow bar tongue means (18) to a front of the frame, means for temporarily securing the tongue means relative to the trailer frame in a first, generally horizontal position and also in a second, generally vertical position, a vertically orientated message board (38) carried by the trailer frame and aligned fore-and-aft therewith, the tongue means having a front upper guide channel (16) for engaging a front portion of the message board when the tongue means is in the second position, the trailer frame also having leg means (30) attached to a front part of the trailer frame so as to support the frame when the tongue is disconnected from the towing vehicle, the method comprising the steps of:

1. moving the leg means (30) to support the front of the trailer;
2. releasing the coupler hitch (20) from the towing vehicle;
3. releasing the hitch means (8) for temporarily securing the lower end of the tongue means (24) to the frame, and
4. raising the tongue means (18) to a vertical position allowing the front upper guide channel (16) to engage the front portion of the message board (38), providing ground support (10) to the frame, and
5. elevating the rear of the message board by means of a rack (66) and pinion mechanism, while the front of the message board slides upwardly relative to the locating means on the tongue means, and 6. securing the raised front portion of the message board by tightening the threaded fasteners (64), on the threaded rods (14) the lower of which conjoins the overlapping support members (42) and (16).

The embodiments of the invention in which an exclusive property or privilege is claimed are defined as follows:

1. A trailer vehicle for transporting and displaying signs including highway message board signs, comprising:

a wheel-mounted trailer with a normally horizontal frame;

tow bar tongue means having a front portion with a coupler hitch for connecting to a towing vehicle and having a rear end portion;

pivot means connecting said rear end portion of the tongue means to a front of the frame, said pivot means allowing pivoting of the tongue means relative to the frame between a first position in which the tongue means is connected to the towing vehicle, and a second, raised position generally perpendicular to the first position when the trailer vehicle is stationary;

means for temporarily securing the tongue means relative to the frame in the first and second positions;

a message board carried by said frame in vertical, fore-and-aft orientation;

and locating means mounted on a front portion of the tow bar tongue means for engaging a front end portion of the message board when the trailer vehicle is stationary and when the tongue means is in said second position.

2. A trailer vehicle according to claim 1, wherein said frame carries a rear vertical support track which locates a rear end of said message board and which allows for guided vertical movement of the rear end of the message board to an elevated position, means being provided for raising the message board, and wherein said locating means mounted on the front portion of the tongue means is in the form of a front upper guide channel which, when the tongue means is in said second position, is adapted to guide vertical movement of the front end of the message board.

3. A trailer vehicle according to claim 2, wherein said rear vertical support track is of lower height than the upper end of said front upper guide channel when the tongue means is in said second position.

4. A trailer according to claim 2, wherein the means for raising the message board includes a rack and pinion mechanism incorporated in said rear vertical support track.

5. A trailer according to claim 2, wherein said frame includes a box or compartment for holding materials or equipment, said box or compartment serving to support said vertical support track.

6. A trailer vehicle according to claim 1, wherein the frame also carries fixed lower front vertical support means for a lower front end portion of the message board.

7. A trailer vehicle according to claim 6, wherein said fixed lower front vertical support means is in the form of a lower guide channel which receives the lower front end portion of the message board, and in which, when the tongue means is in its raised position, the upper guide channel overlaps and forms a continuation of the lower guide channel.

8. A trailer according to claim 7, wherein said lower guide channel and said upper guide channel are both secured by threaded rods to the front end of the message board when the board is in its elevated position, the lower of which conjoins them both at the point of overlap.

9. A trailer vehicle according to claim 1, wherein said tongue means has rearward end means which contact a ground surface when the tongue means is in said second position to support the front end of the trailer.

10. A trailer vehicle according to claim 1, also incorporating leg means attached to a front portion of said frame to be movable from a raised position when the vehicle is travelling, to a lowered position to support the frame when the tongue means is disconnected from the vehicle.

11. A trailer vehicle according to claim 10, wherein said means for temporarily securing the tongue means relative to the frame in said first position includes hitch pins insertable through side members of said frame and through a rear end portion of said tongue means, and wherein said hitch pins are also usable for holding said leg means relative to said frame side members when the leg means is in raised position.

12. A trailer vehicle according to claim 1, wherein said tongue means is Y shaped, having two side arms individually connected to side members of said frame.

13. A method for converting a trailer vehicle from a transporting mode to a message board display mode, wherein the vehicle has a wheel-mounted trailer frame with tow bar tongue means having a front end with a coupler hitch for connection to a towing vehicle, and pivot means connecting the tow bar tongue means to a front of the frame, means for temporarily securing the tongue means relative to the trailer frame in a first, generally horizontal position and also in a second, generally vertical, position, a vertically orientated message board carried by said trailer frame and aligned fore-and-aft therewith, the tongue means having locating means for engaging a front portion of the message board when the tongue means is in said second position, the trailer also having a leg means attached to a front part of the trailer frame so as to support the frame when the tongue is disconnected from the towing vehicle, the method comprising the steps of:

(a) moving the leg means to support the front of the trailer;

(b) releasing the coupler hitch from the towing vehicle;

(c) releasing the means for temporarily securing the tongue means to the frame, and (d) raising the tongue means into a vertical position allowing the locating means to engage the front portion of the message board.

14. The method of claim 13, wherein, after raising the tongue means to the vertical position, the message board is elevated by means of a rack and pinion mechanism, while the front of the message board slides upwardly relative to the locating means on the tongue means and is secured in the raised position with threaded rods, fasteners and a suitable locking device.

* * * * *